United States Patent [19]

Sherwood

[11] 4,379,519

[45] Apr. 12, 1983

[54] PAPER BAG STIFFENER

[75] Inventor: Tom W. Sherwood, Las Vegas, Nev.

[73] Assignee: Unique Products Company, Inc., Las Vegas, Nev.

[21] Appl. No.: 255,540

[22] Filed: Apr. 20, 1981

[51] Int. Cl.[3] ..... B65D 33/02

[52] U.S. Cl. ..... 229/55; 229/53

[58] Field of Search ..... 141/390, 316, 10, 313, 141/314, 315, 317; 229/55, 57, 53, 49, 41 B; 248/99; 220/404; 206/806; 53/384, 390; 150/1.6, 1.7

[56] References Cited

U.S. PATENT DOCUMENTS

| | | | |
|---|---|---|---|
| 985,829 | 3/1911 | Nickerson | 141/313 |
| 1,055,745 | 3/1913 | Harrison | 248/99 |
| 1,421,628 | 7/1922 | Watkins | 220/404 |
| 1,458,216 | 6/1923 | Wood | 248/99 |
| 1,673,535 | 6/1928 | Sheehy | 220/404 |
| 1,911,724 | 5/1933 | Stein | 220/404 |
| 1,947,835 | 2/1934 | Dubbs | 220/404 |
| 3,162,353 | 12/1964 | Sylvester et al. | 229/53 |

*Primary Examiner*—Stephen P. Garbe
*Attorney, Agent, or Firm*—Seiler & Quirk

[57] ABSTRACT

A conventional stiff paper bag adapted to be maintained in an open or folded condition is maintained in the open position by a pair of disposable U-shaped stiffeners which mount over the upper edges of opposing side panels of the bag. The stiffeners preclude creases in the side panels from tending to relax the bag into the folded condition. The stiffeners are preferably slightly longer than the horizontal dimension of the side panels to force the bag mouth into the open position.

3 Claims, 5 Drawing Figures

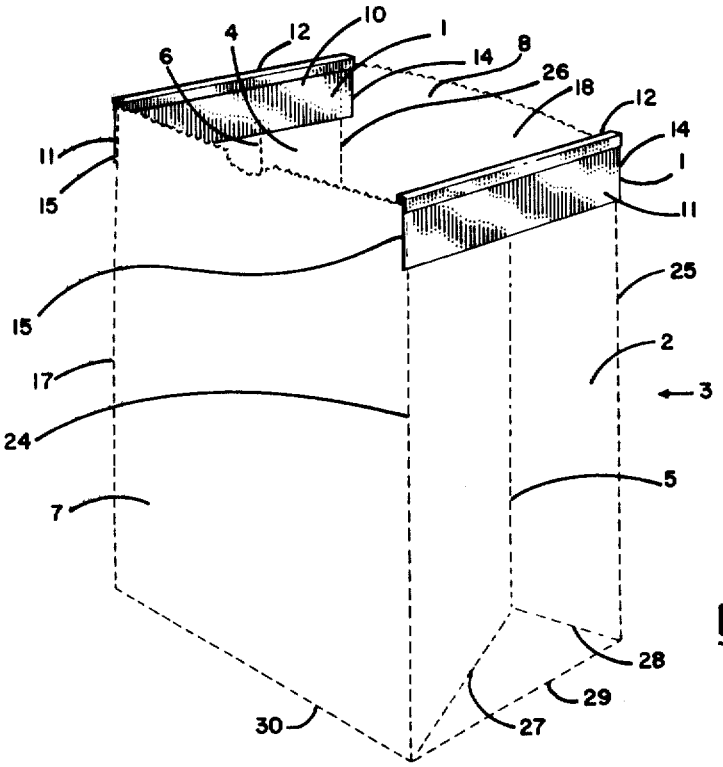
FIG. 1
FIG. 2
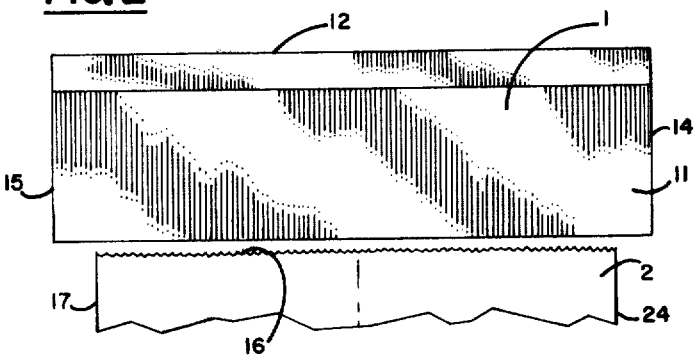
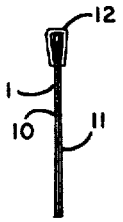
FIG. 3
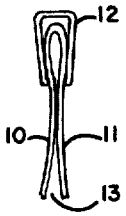
FIG. 4
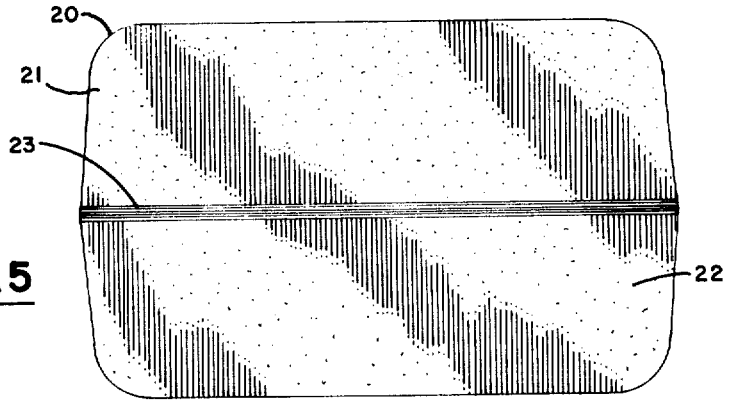
FIG. 5

PAPER BAG STIFFENER

BACKGROUND OF THE INVENTION

This invention relates to paper bags, and in particular to paper bags having removable stiffening members which will maintain the mouth of the bag open and prevent the bag from reverting to a folded position.

It is common practice for supermarkets and variety stores to package customer's goods by placing them in a relatively tough, conventional paper bag. These paper bags or sacks are of a substantially standard size and shape, having a uniform rectangular horizontal cross-section, a flat bottom, and measuring approximately 12 inches long by 7 inches wide by 17 inches high. To enable a supermarket to conveniently store these bags for use, the bags are folded by creasing the opposing longitudinal side panels, permitting the opposing long panels to be folded together and the bottom panel to be folded alongside.

It is very common practice for purchasers of supermarket goods to save paper sacks for use around the home, e.g., as refuse receptacles. The bags may be placed inside of round or rectangular containers, such as waste baskets, or may simply be used themselves as freestanding containers, since the bags have sufficient rigidity to be self-maintaining in an upright position. The bag thereby serves as a handy container for refuse which may be thrown away along with the refuse. At the present time, millions of these bags are dispensed daily at no extra cost to the consumer.

A recurring and irritating problem associated with the use of paper sacks as refuse receptacles involves the "memory" of the bag which causes a tendency to return to its folded condition. When a bag is placed in upright position, the vertical creases in the opposing side panels tend to return to the folded condition, thereby closing the mouth of the bag. Accordingly, when refuse is thrown into the bag, it is necessary to reach over and open the mouth of the bag with one hand while jettisoning the refuse with the other hand. The present invention solves this problem by providing for use with a creased sack a pair of stiffening members which clip over the upper edges of the creased side panels, thereby preventing the side panels from collapsing to their folded condition. The stiffening members comprise a pair of rigid or semi-rigid flaps which extend over the upper edges of the side panels and a clip which extend over the flap and grips the flap in place on the side panel. In addition to maintaining the bag in an open position, the flaps of the stiffening members can be used to carry advertising, e.g., a supermarket name or logo.

It is known in the prior art to have devices which fit inside the openings of various types of bags to maintain the bag mouth in an open position. For example, Kaiser, U.S. Pat. No. 791,472, and Boyle, U.S. Pat. No. 4,037,778, disclose various devices which can be inserted into the interior of limp plastic or cloth bags to provide support for holding the bags. Both of these devices are somewhat complex, non-disposable devices, each serving a purpose other than support; for example, the Boyle device protects the plastic bag from contact with refuse entering the bag during loading, and the Kaiser device acts as a scoop for guiding material into the bag. Buttery, U.S. Pat. No. 2,430,155 shows a different sort of holder for a plastic bag. A paper bag having its upper edges lined on the interior with a flexible but tough reinforcement member such as a wire is shown in Arai, U.S. Pat. No. 3,578,236. The internal wire permits the bag to be easily retained in the open or closed position; however, manufacture of the bag is somewhat more expensive than is justified by normal supermarket retailing operations.

It is also well known to have paper clip type members which are used in conjunction with a foldable member which is intermediary between the clip and the article to be held, as shown for example in Woodley, U.S. Pat. No. 1,997,894, and Brady, U.S. Pat. No. 2,774,124.

Accordingly, it is an object of the present invention to provide a combination of a stiffening member with a creased paper bag which will enable the paper bag to be self-supporting with the bag mouth retained in the open position. It is a particular object of the invention to provide a combination of a semi-rigid paper bag with a pair of stiffening members mounted upon opposing upper edges of the bag, with the length of each stiffening member slightly exceeding the length of the edge of the bag panel on which it is mounted, thereby forcing the bag opening into a somewhat round configuration. These and other objects of the invention will be apparent from the following detailed description of a preferred embodiment thereof.

SUMMARY OF THE INVENTION

In combination, a paper bag adapted to be maintained in an open or folded position having front, rear, and side panels and having a substantially uniform rectangular cross-section, with longitudinal creases into two opposing side panels extending to the upper edges of the bag, and a pair of stiffening members removably mounted over the upper edges of the opposing side panels to maintain the bag mouth in an open position. In a preferred embodiment, the length of the stiffening member slightly exceeds the length of the side panel, thereby forcing the bag to maintain a slightly round configuration.

BRIEF DESCRIPTION OF THE DRAWINGS

The invention is best understood with respect to the drawings, in which:

FIG. 1 is a perspective view of the combination of the invention with the bag shown in phantom;

FIG. 2 is a side view of a stiffening member in exploded position relative to the side of the bag;

FIGS. 3 and 4 are end views of one embodiment of a stiffener; and

FIG. 5 shows a stamped foamed plastic stiffener having a central rib, shown in its open (non-folded) position.

DETAILED DESCRIPTION OF THE INVENTION

Referring to FIG. 1, bag 3, fabricated from tough, resilient paper, is shown maintained in its open position by stiffening members 1 located on opposed side panels 2 and 4 of the bag. The bag is a standard grocery bag having front and back panels 7 and 8, respectively, and side panels 2 and 4; the bag has a rectangular cross-section which is substantially uniform from the bottom to the top of the bag. The bag has a flat bottom panel (not shown) which adjoins the vertical panels at the lower edges, of which side edge 29 and longitudinal edge 30 are shown in FIG. 1. The vertical panels of the bag are defined by edges 17, 24, 25, and 26 of the bag.

As conventionally folded, grocery bags have vertical creases at approximately the mid-point of opposing side panels as shown at 5 and 6 in FIG. 1. At its bottom end, the side creases intersect two inwardly inclined creases extending from the corners of the bag, shown as creases 27 and 28. Additional horizontal folding lines in the bag are not shown in FIG. 1 and are not relevant or important to the invention.

As shown in FIGS. 2, 3, and 4, a preferred stiffening member of the invention comprises a folded flap 1 having substantially a U-shape and an elongate clip 12 extending over the "U" portion of the flap. The flap may be made from any material, such as paper, flexible plastic, or styrofoam, and is preferably made from the same quality of paper from which the bag itself is made. The clip 12 is a standard, commercially available device commonly used for fastening a plurality of pages of papers. The clip is a rigid, U-shaped member having an inherent bias tending to squeeze and retain any members inserted into the slot formed by the side panels of the clip. No novelty is claimed in either the clip 12 or the stiffening flap 1 apart from the invention as described herein. As shown in the end views in FIGS. 3 and 4, the flap has side panels 10 and 11 which are relatively flexible, permitting easy opening to form a slot 13 to receive the upper edge of the bag panels.

An important feature of the invention concerns the relative sizes of the stiffening member and the side panels of the bag. As best seen in FIG. 2, the length of the stiffening member (i.e., the distance between side edges 14 and 15 of the flap) is slightly longer than the length of the side panel of the bag (i.e., the distance between edges 24 and 25). The stiffener is about ½"–1½", preferably about 1", longer than the length (i.e., horizontal dimension) of the side panel. Typically, for a bag having a 7" side panel, the stiffening member is about 8" long by about 2" high. When the stiffener is set in place over the upper edge 16 of the bag, the bag mouth 18 is forced into a somewhat oval shape because the edges 14 and 15 of the stiffener extend beyond the edges of the side panel, forcing the front and rear panels into a bowed configuration as shown in FIG. 1. The configuration is particularly helpful in maintaining a wide opening into which refuse may be placed.

The stiffeners or spreaders of the invention are used very simply by opening the side panels 10 and 11 of the stiffening flap and inserting the upper edge 16 of a side panel into the slot 13 of the stiffener. The stiffener is then pressed down over the upper edge of the bag until the upper edge extends into the opening of the jaws of clip 12, thereby attaining the position shown in FIG. 1. The stiffeners thus prevent the vertical creases in the side panels from folding inwardly and closing the bag mouth. With the stiffeners in place, the bag is completely free-standing.

While a preferred embodiment of the stiffener of the invention is shown in FIGS. 1 through 4, various other stiffener configurations are contemplated. For example, while a two-piece stiffener construction is shown, a single integral stiffener member may be used. A specific one-piece stiffener is shown in FIG. 5; this stiffener 20 is a styrofoam sheet having flat panels 21 and 22 and having a ribbed spine 23. This stiffener can easily be fabricated by stamping styrofoam sheets, and is used by folding the device along spine 23 to form a U-shaped configuration similar to the one shown in FIG. 3. The stiffeners may be made from paper, plastics, or any other material; material is generally dependent on cost, since it is essential to keep the cost as low as possible. In principle, any member which can be slid in place over the upper edge of the bag panel and which has sufficient stiffness to retain the bag mouth in the open position may be used.

An alternate method of use of the bag spreaders of the invention involves placing the stiffeners over the side panels of the bag as shown in FIG. 1, and then sliding both stiffeners forward such that the stiffeners no longer cover the creases formed between the side panels and the rear panel. In this mode, the back panel rests square to the side panels, and the front panel bows forward to provide an opening the measures about 11" front-to-back.

A substantial advantage to the stiffeners as shown and described herein is that they are extremely inexpensive to manufacture and may be discarded along with the bag when it is full of refuse. In addition, the panels of the stiffener may be decorated with artwork or with advertising, such as the names of a particular market. Accordingly, the invention should not be considered limited by the specific embodiments disclosed herein, and many variations and modifications are possible within the spirit and scope of the invention. Accordingly, the invention should be considered limited only by the following claims.

I claim:

1. In combination, a bag adapted to be maintained in an open position or a folded position, the bag having front, rear, and opposing side panels defining a rectangular horizontal cross-section when the bag is in the open position, upper edges of said panels defining a bag mouth, the opposing side panels having the intermediate vertical creases therein, and stiffening members, each having a length greater than the horizontal dimension of the side panel of the bag, removably mounted over the upper edges of the opposing side panels to maintain the bag mouth in the open position.

2. The combination of claim 1 wherein the stiffening member has a length about ½"–1½" greater than the horizontal dimension of the side panel of the bag.

3. The combination of claim 1 wherein the stiffening member has a length about 1" greater than the horizontal dimension of the side panel of the bag.

* * * * *